US006338322B1

(12) United States Patent
Ogawa et al.

(10) Patent No.: US 6,338,322 B1
(45) Date of Patent: Jan. 15, 2002

(54) VALVE TIMING CONTROL DEVICE

(75) Inventors: Kazumi Ogawa, Toyota; Katsuhiko Eguchi; Hideki Nakayoshi, both of Kariya; Yoshitomo Nakai, Chiryu, all of (JP)

(73) Assignee: Aisin Seiki Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 09/540,038

(22) Filed: Mar. 31, 2000

(30) Foreign Application Priority Data

Mar. 31, 1999 (JP) ..... 11-091833

(51) Int. Cl.[7] ..... F01L 1/34

(52) U.S. Cl. ..... 123/90.17; 123/90.33; 74/568 R

(58) Field of Search ..... 123/90.15, 90.17, 123/90.31, 90.33; 74/568 R

(56) References Cited

U.S. PATENT DOCUMENTS 5,901,674 A * 5/1999 Fujiwaki ..... 123/90.17
6,053,138 A * 4/2000 Trzmiel et al. ..... 123/90.17

FOREIGN PATENT DOCUMENTS

| | | | |
|---|---|---|---|
| EP | 857859 | * | 8/1998 |
| JP | 9-60508 | | 3/1997 |
| JP | 10-141022 | | 5/1998 |
| WO | WO 98/46864 | | 11/1997 |

* cited by examiner

*Primary Examiner*—Weilun Lo
(74) *Attorney, Agent, or Firm*—Reed Smith Hazel & Thomas LLP

(57) ABSTRACT

A valve timing control device incorporates a rotary member which rotates with one of a crankshaft of an internal combustion engine and a camshaft thereof, a rotational transmitting member which rotates with the other of the camshaft and the crankshaft; a vane provided on the rotary member; a pressure chamber formed between the rotary member and the rotational transmitting member, and divided into an advancing chamber and a delaying chamber by the vane; an oil retainer disposed between one axial end of the rotational transmitting member and one axial end of the rotary member; and a pressurized portion disposed between the other axial end of the rotational transmitting member and the other axial end of the rotary member.

3 Claims, 5 Drawing Sheets

VALVE TIMING CONTROL DEVICE

BACKGROUND OF THE INVENTION

1. Field of the Invention

The present invention relates to a valve timing control device and, in particular, to the valve timing control device for controlling an angular phase difference between a crankshaft of a combustion engine and a camshaft of the combustion engine.

2. Conventional Technology

A conventional valve timing control device comprises: a rotary member rotates with a crankshaft of an internal combustion; a rotational transmitting member rotates with a camshaft; a vane provided on the rotary member; and a pressure chamber formed between the rotary member and the rotational transmitting member, and divided into an advancing chamber and a delaying chamber by the vane. The rotational transmitting member has a cylindrical housing member mounted around the peripheral surface of the rotary member, and two circle plate members fixed on ends of the cylindrical housing member and a timing sprocket connected to a crankshaft by a timing chain. Such a conventional variable timing device is disclosed, for example, in Japanese Patent Laid-Open Publication No. H(Heisei) 10-141022.

In the conventional valve timing control device, the valve timing is advanced due to relative displacement between the rotary member and the rotational transmitting member the fluid is supplied to the advancing chamber and is discharged from the delaying chamber. On the contrary, the valve timing is delayed due to the counter displacement between the rotary member and the rotational transmitting member when the fluid is discharged from the delaying chamber and is supplied to the delaying chamber.

Further, in the conventional valve timing control device disclosed in the publications, there are predetermined gaps between the outside surfaces of the cylindrical housing member and the inside surfaces of each of the plate member. The gaps are filled up with a small amount of the fluid that is leaked from the advancing chamber and/or the delaying chamber so as to make fluid slicks. Therefore, the operation of the conventional valve timing control device quickens.

However, even if the rotational phase (the angular phase difference) between the crankshaft and the camshaft is fixed on the internal combustion engine driving, the camshaft receives variational torque so that the rotary member continuously rotates relative to the rotational transmitting member within a small range. At the time, as loads of the gaps to maintain the fluid slicks become large, it is difficult to keep the small amount of the fluid in the gaps.

In addition, here exists some risk that the tension of the timing chain, which connects between the crankshaft and the timing sprocket, may make one of the gaps small. As a result, the fluid slick between one of the outside surfaces of the cylindrical housing member and the inside surface of the plate member may disappear such that the internal opposition increases.

SUMMARY OF THE INVENTION

The invention has been conceived to solve the above-specified problems. According to the invention, there is provided a valve timing control device comprising: a rotary member that rotates with one of a crankshaft of an internal combustion engine or a camshaft thereof; a rotational transmitting member that rotates with the other of the camshaft or the crankshaft, and which has a cylindrical housing portion mounted around the peripheral surface of the rotary member and a circle plate portion fixed on one end of the cylindrical housing portion and slidably contacted with one end of the rotary member; a vane provided on the rotary member; a pressure chamber formed between the rotary member and the rotational transmitting member, and divided into an advancing chamber and a delaying chamber by the vane; and an oil retainer disposed between the circle plate portion of the rotational transmitting member and the rotary member.

Other objects and advantages of invention will become apparent during the following discussion of the accompanying drawings.

BRIEF DESCRIPTION OF THE DRAWINGS

The foregoing and additional features of the present invention will become more apparent from the following detailed description of embodiments thereof when considered with reference to the attached drawings, in which.

DETAILED DESCRIPTION OF THE PREFERRED EMBODIMENTS

Figure 1:
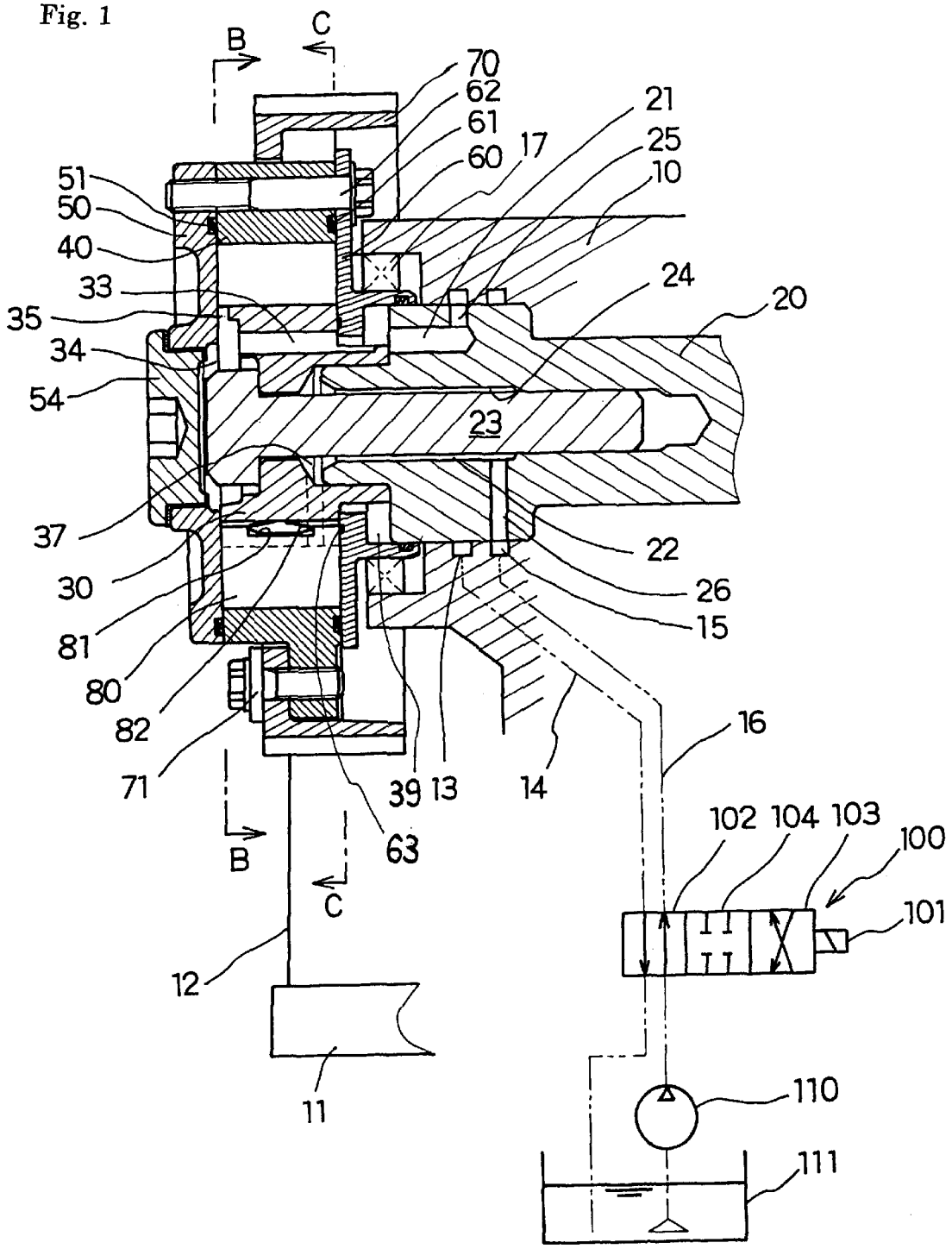
FIG. 1 is a vertical sectional view of the first embodiment of a valve timing control device in accordance with the present invention.

A valve timing control device in accordance with preferred embodiments of the present invention will be described with reference to the attached drawings.

The first embodiment of a valve timing control device according to the present invention, as shown in FIGS. 1 through 5, is constructed so as to comprise a rotary member which includes a rotor 30 that rotates with a camshaft 20; a rotational transmitting member mounted around the rotor 30 so as to rotate relative thereto within a predetermined range and including a housing 40, a front plate 50, a cap 54, a rear plate 60 and a timing sprocket 70; six vanes 80 assembled with the rotor 30; a lock pin (not shown) assembled with the housing 40. The camshaft 20 is rotatably supported by a cylinder head 10 of an internal combustion engine. The rotor 30 is integrally provided on the leading end portion of the camshaft 20. The timing sprocket 70 is fixed to the housing 40 by means of three bolts 71. The timing sprocket 70 is constructed, as is well known in the art, to transmit the rotating power to the clockwise direction of FIG. 2 (the counter-clockwise direction of FIG. 3) from a crankshaft 11 via a timing belt 12. The timing belt 12 is made of resin or rubber. Here, it is possible to use a timing chain or timing gears instead of the timing belt 12.

The camshaft 20 is equipped with a well-known cam (not shown) for opening and closing an intake valve (not shown)

and is provided therein with an advance passage 21 and a delay passage 22, which are extended in the axial direction of the camshaft 20. The advance passage 21 is connected to a first connection port 105 of a control valve 100 via a radial passage 25, an annular passage 13, a connection passage 14. On the other hand, the delay passage 22, which is disposed around a bolt 23, is connected to a second connection port 106 of the control valve 100 via a radial passage 26, an annular passage 15 and a connection passage 16.

The control valve 100 includes a solenoid 101, a spool (not shown) and a spring 107. In FIG. 1, the solenoid 101 drives the spool leftward against the spring 107 when the solenoid 101 is energized. In the energized state, the control valve 100 connects an inlet port 108 to the first connection port 105 and also connects the second connection port 106 to a drain port 109 (the first position 103). On the other hand, in the normal state, the control valve 100 connects the inlet port 108 to the second connection port 106 and also connects the first connection port 105 to the drain port 109 (the second position 102), as shown in FIG. 1. The solenoid 101 of the control valve 100 is energized by an electronic controller (not shown). As a result, an operational fluid (working oil) is supplied to the delay passage 22 when the solenoid 101 is deenergized, and to the advance passage 21 when the same is energized. Because of duty ratio control of the electronic controller, the spool may be linearly controlled so as to be retained at various intermediate position (the third position 104). All the ports 105, 106, 108 and 109 are closed while the spool is retained at the intermediate position.

Figure 2:
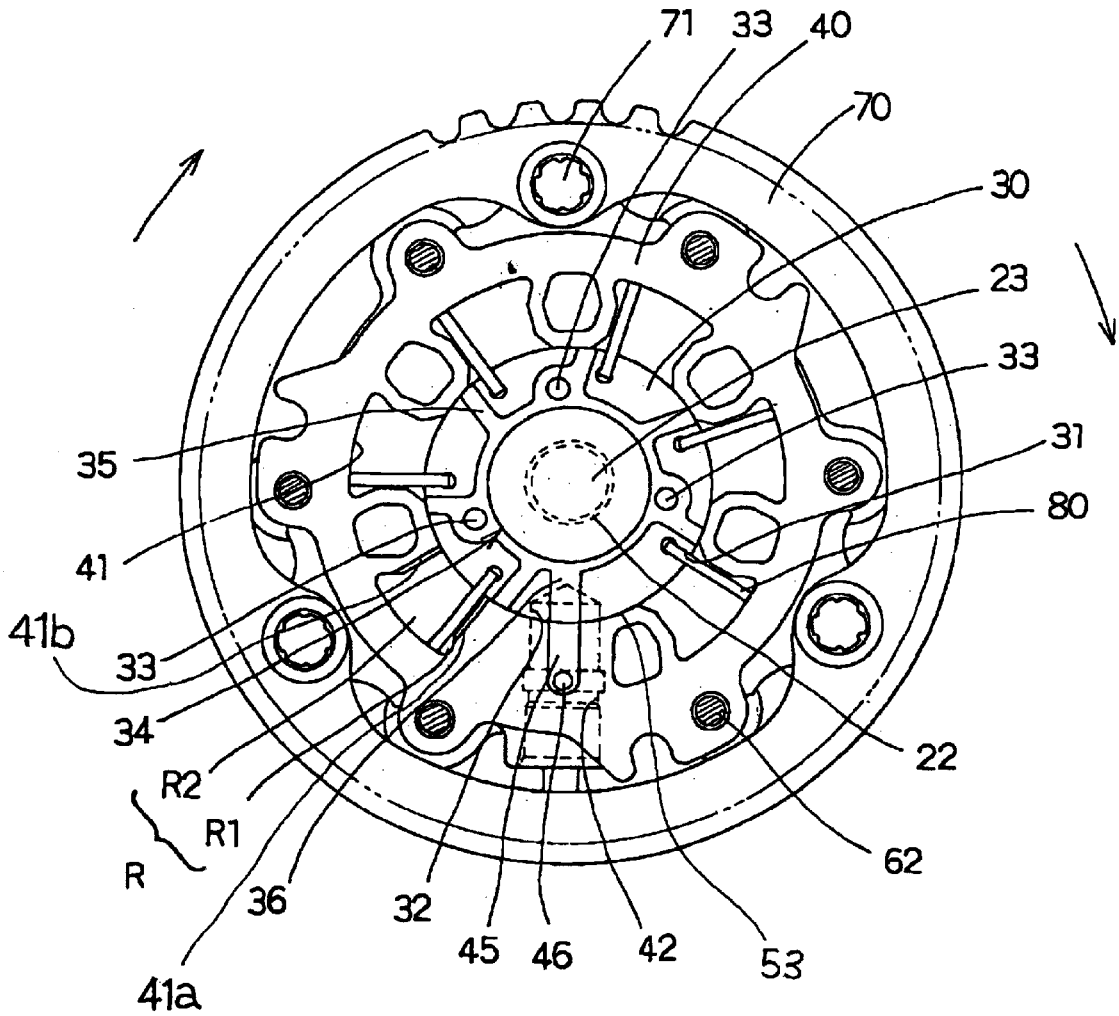
FIG. 2 is a sectional view taken along the line B—B in FIG. 1.

The rotor 30 is integrally fixed in the camshaft 20 by means of the bolt 23 and is provided with six vane grooves 31 for providing the six vanes 80 individually in the radial directions. Both the rotor 30 and the vanes 80 are made of one kind of iron material. Further, the rotor 30 has a fitting hole 32 for fitting the locking pin (not shown) to a predetermined extent in the state shown in FIG. 2, where the camshaft 20, the rotor 30 and the housing 40 are in synchronized phase (the vanes 80 are in the most delayed position of pressure chambers R). In addition, the rotor 30 has three axial passages 33, groove passages 35 and radial passages 38. One end of each of the axial passages 33 is connected to the advancing passage 21 via an annular space 39, and the other end of the same is connected to the groove passages 35. The groove passages 35 are for supplying and discharging the operational fluid to and from advancing chambers R1, as defined by the individual vanes 80 via the advance passage 21 and the axial passages 33. The groove passages 38 are for supplying and discharging the operational fluid to and from delaying chambers R2, as defined by the individual vanes 80 via the delay passage 22 and an annular space 37. Further, as shown in FIG. 2, on the outer circumference of the rotor 30, there is a groove passage 53 which communicates between the fitting hole 32 and one of the delaying chambers R2*a*. Here, the annular space 37 and the annular space 39 are completely separated by means of a cylindrically portion 30*a* of the rotor 30. The top of the cylindrically portion 30*a* is fluid tightly fitted to the end portion of the camshaft 20 by the bolt 23. Each of the vane 80 is urged radially outward by a vane spring 82 disposed between the bottom portion of a vane groove 31 and a groove 81 of the vane 80.

The housing 40 of the rotational transmitting member is so assembled with the outer circumference of the rotor 30 so as to rotate relative thereto within a predetermined range. There is a small gap between the outer circumference of the housing 40 and the inner circumference of the rotor 30 so as to make a fluid slick. To the two sides of the housing 40, there are joined the front plate 50 and the rear plate 60 with seal members 51 and 61 by means of six bolts 62. In this structure, the inside surface of the front plate 50 is disposed toward the one end of the vanes 80 and one axial end of the rotor 30 via a small-predetermined gap. On the other hand, the inside surface of the rear plate 60 is disposed toward the other end of the vanes 80 and the other axial end of the rotor 30 via another small-predetermined gap. Thus, the rotational transmitting member can rotate around the rotor 30 via the operational fluid in the small gap and in the small-predetermined gaps. Both of the housing 40 and the rear plate 60 are made of one kind of the iron material, but the front plate 50 is made of one kind of aluminum material. A cap 54 is fluid tightly fixed to the front plate 50 so as to provide a passage 34 which includes the advance passage 21, the axial passages 33 and groove 35. Further, six hollow portions 41 and a bore 42 are formed inwardly in the housing 40, as shown in FIG. 2. Each of the pressure chambers R are composed of the outer circumference of the rotor 30, the inside wall of the hollow portions 41 of the housing 40, the front plate 50 and the rear plate 60. Each of the pressure chambers R is divided into an advancing chamber R1 and a delaying chamber R2 by the vane 80. The lock pin and a spring (although not shown) for urging the lock pin toward the rotor 30 are contained in the bore 42 that extends in radial direction of the housing 40. Here, there is an oil seal 17 which is disposed in the cylinder head 10 so as to engage with the outside circumference of a cylinder portion 64 of the rear plate 60. On the other hand, the inside circumference of the cylinder portion 64 can rotate relative to the outside circumference of the camshaft 20 via an O-ring 65. In addition, as shown in FIG. 2, the housing 40 has a groove 45 and a hole 46 for draining the operational fluid from the spring portion of the bore 42 into the groove 35 of the passage 34 via a passage 36.

In this embodiment as shown in FIGS. 1, and 3 through 5, an annular groove 63 is formed on the front surface of the rear plate 60, where is toward the axial end surface of the rotor 30. The inward wall of the annular groove 63 is arranged along the inside ends of the vanes 80. The operational fluid leaks from the chambers R to the annular groove 63 via the small-predetermined gap between the front surface of the rear plate 60 and the axial end surface of the rotor 30. The operational fluid in the annular groove 63 is maintained so as to keep fluid slick there between. Accordingly, the rotational area between the front surface of the rear plate 60 and the axial end surface of the rotor 30 slides smoothly.

Figure 3:
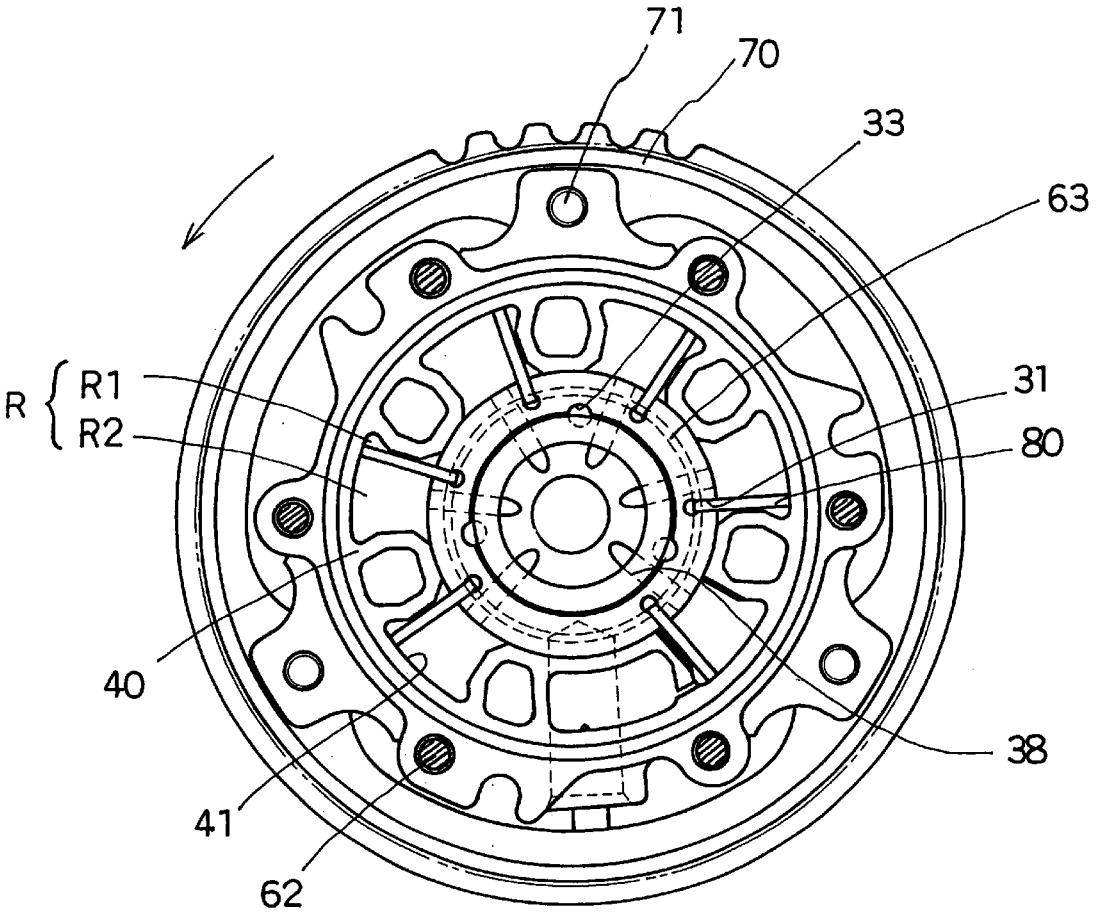
FIG. 3 is a sectional view taken along the line C—C in FIG. 1.
Figure 5:
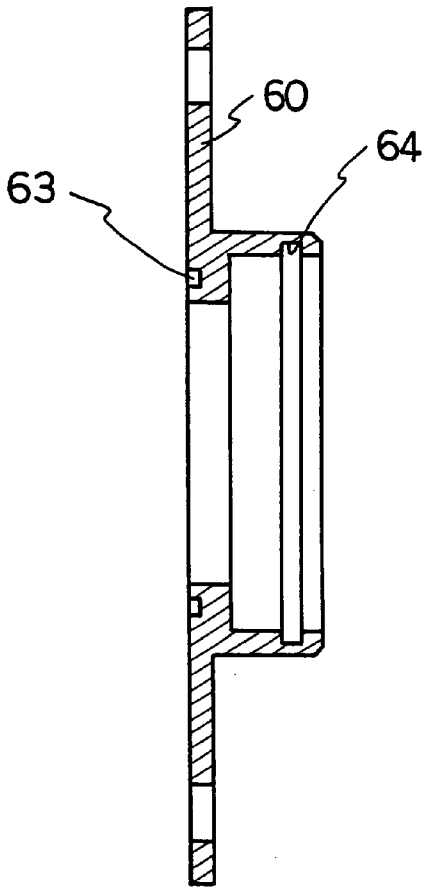
FIG. 5 is a sectional view of the rear plate in FIG. 1.
Figure 4:
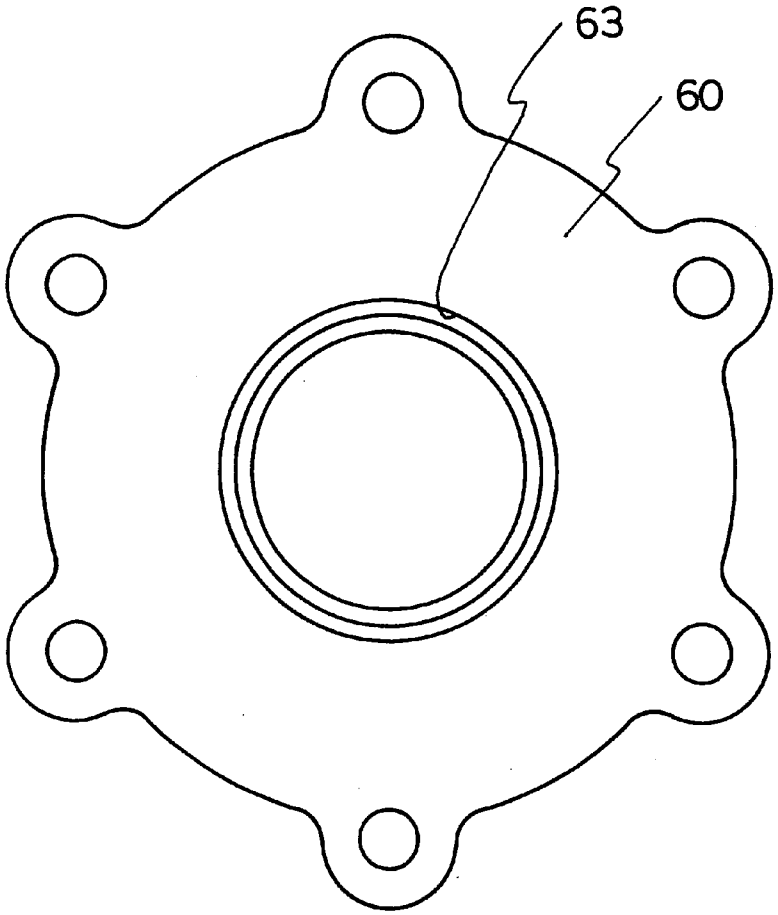
FIG. 4 is a plan view of a rear plate in FIG. 1.

In this embodiment, in order to limit the relative rotation between the rotor 30 and the rotational transmitting member (the housing 40, the front plate 50 and the rear plate 60) within a predetermined range, one of the vanes 80 (a vane 80*a* which is described at the lower left in FIG. 2) touches with stoppers 41*a* and 41*b*. As shown in FIGS. 2 and 3, when the vane 80*a* touches with the stopper 41*a*, each of the groove. passage 35 communicates with each of the advancing chamber R1, respectively. On the other hand, when the vane 80*a* touches with the stopper 41*b*, each of the radial passage 38 communicates with each of the delaying chamber R2, respectively.

In the above embodiment, when the internal combustion engine stalls, an oil pump 110 is no longer driven by the internal combustion engine and the solenoid 101 of the control valve 100 is not energized so that the pressure chambers R do not receive the operational fluid anymore. In this condition, neither the pressure in the advancing chamber R1 nor the pressure in the delaying chambers R2 is applied to the vanes 80, but only the rotational counter force is applied to the vanes 80 toward the most delayed position until the crankshaft 11 of the internal combustion engine is completely stopped. Further, the lock pin (not shown) locks between the rotor 30 and the housing 40 at the most delayed portion between the rotor 30 and the housing 40.

Then, when a starter switch turns on for cranking the internal combustion engine, the solenoid 101 of the control valve 100 is not energized so that the operational fluid supplies to the connection passage 16 via the control valve 100. Then each of the delaying chambers R2 is supplied the operational fluid. At the same time, the connection passage 14 connects to an oil pan 111 via the control valve 100 so that the operational fluid discharges from the advancing chambers R1 to the oil pan 111 via the passage 34 and the advancing passage 21. In addition, it takes a predetermined time to fill the fitting hole 32 with the operational fluid. Since this operation prevents the rotor 30 with vanes 80 from rotating relative to the housing 40, the vane 80*a* does not contact with either stopper 41*a* or 41*b* thereby preventing noise in the cranking period.

After the predetermined time, the fitting hole 32 is filled with the operational fluid so as to slide the lock pin (not shown) toward the bore 42. As the lock pin releases the connection between the rotor 30 and the housing 40, the rotor 30 with vanes 80 can rotate relative to the rotational transmitting member (the housing 40 and so on).

At this condition, if the duty ratio of current to supply the solenoid 101 of the control valve 100 increases, the operational fluid supplies to the advance passage 21 and discharges from the delay passage 22. The pressure of the operational fluid in the advancing chambers R1 increases so as to urge the vanes 80 toward the advanced direction until it reaches the most advanced position, where the vane 80*a* contacts with the stopper 41*b*. After that, if the duty ratio of current to supply the solenoid 101 of the control valve 100 decreases, the operational fluid in the delaying chambers R2 increases and the operational fluid in the advancing chambers R1 decreases so as to urge the vanes 80 toward the delayed direction. As a result, the relative rotational phase between the crankshaft 11 and the camshaft 20 is controlled according to the conditions of the internal combustion engine.

Further, the duty ratio of the solenoid 101 of the control valve is controlled so as to supply both of the advancing chamber R1 and the delaying chamber R2 with the operational fluid. As a result, the rotational phase between the rotor 30 and the rotational transmitting member (the housing 40 and so on) can vary between the most delayed position and the most advanced position. At that time, the rotor 30 receives torque toward the delayed direction, since the camshaft 20 receives variational torque from the cams (not shown). Thus, the operational fluid pressure of the advancing chamber R1 is greater than that of the delaying chamber R2 by the duty ratio of the solenoid 101 of the control valve 100.

In the above condition where the rotational phase between the crankshaft 11 and the camshaft 20 is fixed, the variational torque for urging the camshaft 20 makes the rotor 30 rotate relative to the rotational transmitting member within the small range. Accordingly, the axial end surface of the rotor 30 continuously rotates relative to the front surface of the rear plate 60 within the small range. However, in this embodiment, the annular groove 63 of the front surface of the rear plate 60 can keep the operational fluid so as to make the fluid slick between the rotor 30 and the rear plate 60.

Figure 6:
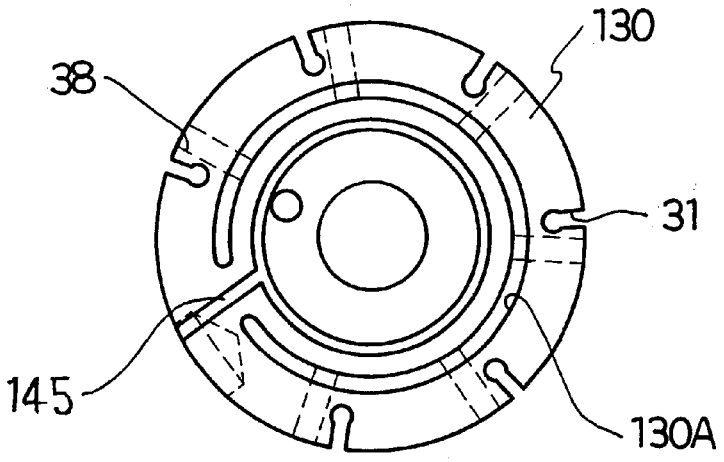
FIG. 6 is a plan view of a rotor of the second embodiment of a valve timing control device in accordance with the present invention.

FIG. 6 illustrates another modified version of the first embodiment, which specifically is a modified arrangement of a rotor 130. In this embodiment, the same parts in the first embodiment are used with the same numerals of the first embodiment. In this modified construction, there is an arc groove 130A of the axial end surface of the rotor 130, where the axial end surface is toward the front surface of the rear plate 60. Here, since the groove 145 for draining the operational fluid from the spring portion of the bore 42 is disposed on the axial end surface of the rotor 130, the arc groove 130A is not an annular form so as to separate from the groove 145. In this embodiment, the arc groove 130A keeps the operational fluid so as to make the fluid slick between the rotor 130 and the rear plate 60.

Figure 7:
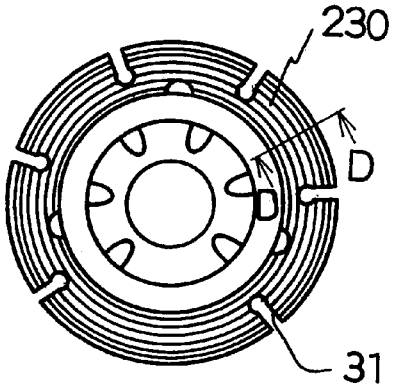
FIG. 7 is a plan view of a rotor of the third embodiment of a valve timing control device in accordance with the present invention.
Figure 8:
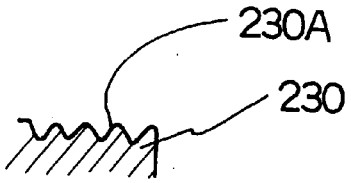
FIG. 8 is a sectional view taken along the line D—D in FIG. 7.

FIGS. 7 and 8 illustrate another modified version of the first embodiment, which specifically is a modified arrangement of a rotor 230. In this embodiment, the same parts in the first embodiment are used with the same numerals of the first embodiment. In this modified construction, there are annular grooves 230A. In this embodiment, each of the annular grooves 230A maintains the operational fluid so as to make the fluid slick between the rotor 230 and the rear plate 60.

Here, the above grooves 63, 130A and 230A for keeping the operational oil are also provided on the rotational portion between the other axial end surface of the rotor 30 (130, 230) and the rear surface of the front plate 50.

Further, in the above embodiment, the camshaft 20 drives the air intake valves of the internal combustion engine. However, this invention may adapt to the other camshafts that drive the exhaust valves of an internal combustion engine.

What is claimed is:

1. A valve timing control device comprising:

a rotary member rotates with one of a crankshaft of an internal combustion engine and a camshaft thereof;

a rotational transmitting member rotates with the other of the camshaft and the crankshaft;

a vane provided on the rotary member;

a pressure chamber formed between the rotary member and the rotational transmitting member, and divided into an advancing chamber and a delaying chamber by the vane;

an oil conduit supplying oil to one of the advancing chamber and the delaying chamber; and an oil retainer disposed between a first axial end of the rotational transmitting member and a first axial end of the rotary member, and formed independent of the oil conduit, wherein the oil retainer includes a groove retaining oil therein and which is provided on at least one of the first axial end of the rotational transmitting member and the first axial end of the rotary member.

2. The valve timing control device according to claim 1, wherein the oil conduit is provided between a second axial end of the rotational transmit member and a second axial end of the rotary member.

3. A valve timing control device comprising:

a rotary member rotates with one of a crankshaft of an internal combustion engine and a camshaft thereof;

a rotational transmitting member rotates with the other of the camshaft and the crankshaft;

a vane provided on the rotary member;

a pressure chamber formed between the rotary member and the rotational transmitting member, and divided into an advancing chamber and a delaying chamber by the vane;

at least one oil conduit supplying oil to at least one of the advancing chamber and the delaying chamber; and an oil retainer disposed between one axial end of the rotational transmitting member and an opposed axial end of the rotary member, and formed independent of the at least one oil conduit, wherein the oil retainer includes a groove retaining oil therein and which is provided on at least one of the one axial end of the rotational transmitting member and the axial end of the rotary member.

* * * * *